US005755351A

United States Patent [19]

Kruzick

[11] Patent Number: 5,755,351

[45] **Date of Patent: *May 26, 1998**

[54] LID ASSEMBLY FOR A CONTAINER

[75] Inventor: Kent Kruzick, Winamac, Ind.

[73] Assignee: Galbreath, Inc., Winamac, Ind.

[ * ] Notice: The term of this patent shall not extend beyond the expiration date of Pat. No. 5,533,643.

[21] Appl. No.: 587,294

[22] Filed: Jan. 16, 1996

Related U.S. Application Data

[63] Continuation of Ser. No. 114,678, Aug. 31, 1993, Pat. No. 5,533,643, which is a continuation-in-part of Ser. No. 877, 401, May 1, 1992, Pat. No. 5,251,775.

[51] Int. Cl.[6] ..... B65D 43/20

[52] U.S. Cl. ..... 220/331; 220/908; 220/345; 220/326

[58] Field of Search ..... 220/331, 333, 220/332, 329, 908, 264, 324, 326, 334, 345, 355

[56] References Cited

U.S. PATENT DOCUMENTS

| | | | |
|---|---|---|---|
| 2,338,477 | 1/1944 | Wolters et al. . | |
| 4,821,902 | 4/1989 | May . | |
| 4,934,562 | 6/1990 | Early et al. | 220/331 |
| 5,251,775 | 10/1993 | Kruzick et al. | 220/908 |
| 5,533,643 | 7/1996 | Kruzick | 220/908 |

*Primary Examiner*—Stephen J. Castellano
*Attorney, Agent, or Firm*—Woodard, Emhardt, Naughton, Moriarty & McNett

[57] ABSTRACT

For a container having sides, a top and an upwardly facing opening in the top, a lid assembly includes a lid member having a width and being sized to cover and seal shut the opening; elements for mounting the lid to the container including a pair of guide rails mountable to the top of the container and at least one guide channel mountable to the top of the container; a plurality of rollers mounted to and at opposite ends of the lid member, the rollers being sized, configured and positioned to ride upon and follow the guide rails; at least one follower roller mounted to the lid member to one of the inside and the outside of the plurality of rollers, the follower roller being sized, configured and positioned to follow and stay operably engaged with the at least one guide channel; and wherein the guide rails and plurality of rollers and at least one guide channel and at least one follower roller all mutually coact to permit the lid member to be moved between a closed and clamped position wherein the lid member is positioned over and tightly clamped to the container to seal shut the opening and a closed and unclamped position wherein the lid member is positioned over the opening but is free to be slid laterally along the guide rails, and to permit the lid member to be moved between the closed and unclamped position and an open position wherein the lid member is positioned away from the opening along either side of the container.

18 Claims, 11 Drawing Sheets

LID ASSEMBLY FOR A CONTAINER

This application is a continuation of U.S. patent application Ser. No. 08/114,678, filed Aug. 31, 1993, now U.S. Pat. No. 5,533,643, which is a continuation-in-part of U.S. patent application Ser. No. 07/877,401, filed May 1, 1992, now U.S. Pat. No. 5,251,775.

FIELD OF THE INVENTION

The present invention relates to the field of waste handling containers and specifically to a container having a very large lid and a combination sliding and pivoting mechanism to facilitate opening and closing the lid.

BACKGROUND OF THE INVENTION

Hazardous waste materials are frequently transported to disposal facilities in very large waste handling containers. A typical such container might measure 8'×18'×5' with an opening in the top thereof measuring 7'×14'. To safely close off this large opening, a one-piece lid must cover the entire opening and form a tight seal against the container body to prevent the hazardous materials from escaping during transport.

One example of such a lid is shown is U.S. Pat. No. 4,934,562 wherein the lid has a downwardly extending, longitudinal flange which rides along rollers positioned on top of the container. A complicated screw-type mechanism is used to raise the lid from a sealed position, and then the lid is slid laterally along the rollers roughly half its width until a pair of spring-biased hooks catch corresponding hinge bars at the edge of the top of the container. The lid is thus hingedly connected to the top of the container and is pivoted to the side and out of the way of the opening. In addition to the significant risk of failure of the screw mechanism to unseal and raise the lid and the difficulty of servicing the screw mechanism, the lid can easily be de-railed from its tracks. Moreover, although fairly heavy, this lid has proven to be highly susceptible to the forces of a good wind gust which has picked the lid up, off and away from the container. It has also been found that the special spring-biased hooks do not reliably engage with the hinge members. This can and has left the lid skewed, de-railed, and jammed. Another example of this general type of sliding lid configuration is shown in U.S. Pat. No. 4,821,902. Here, the lid of a large waste container is supported for gliding horizontal movement atop rollers mounted to the top of the container.

These large waste containers are often transported by rail where maximum container height limits are set by the applicable federal regulation. To maximize the container volume, while staying within the container height limitations, it is desired that the mechanism for supporting the container lid for sliding and pivoting movement project above the container as little as possible.

What is needed is a simple and reliable, but low rising mechanism for permitting the lid of a large hazardous waste handling container to be easily manipulated between a locked and sealed position and an open position clear of the corresponding container opening.

SUMMARY OF THE INVENTION

Generally speaking, in a container for handling waste or other items, the container having a large opening in its top, a low profile lid is provided which can be moved laterally or "slid" to one side or the other of the container and pivoted thereat to an upright position by a single person with little difficulty.

For a container having sides, a top and an upwardly facing opening in the top, a lid assembly includes a lid member having a width and being sized to cover and seal shut the opening; a pair of guide rails mountable to the top of the container; at least one guide channel mountable to the top of the container; a plurality of rollers mounted to and at opposite ends of the lid member, the rollers being sized, configured and positioned to ride upon and follow the guide rails; at least one follower roller mounted to the lid member to one of the inside and the outside of the plurality of rollers, the follower roller being sized, configured and positioned to follow and stay operably engaged with the at least one guide channel; and wherein the guide rails and plurality of rollers and at least one guide channel and at least one follower roller all mutually coact to permit the lid member to be moved between a closed and clamped position wherein the lid member is positioned over and tightly clamped to the container to seal shut the opening and a closed and unclamped position wherein the lid member is positioned over the opening but is free to be slid laterally along the guide rails, and to permit the lid to be moved between the closed and unclamped position and an open position wherein the lid member is positioned away from the opening along one side of the container.

It is an object of the present invention to provide an improved lid assembly for a container.

It is another object of the present invention to provide a lid assembly for a container, the lid assembly including a simple and reliable mechanism for permitting a lid member to be easily manipulated between a closed position covering the corresponding opening and an open position clear of the opening.

Further objects and advantages of the present invention will become apparent from the following description of the preferred embodiment.

DESCRIPTION OF THE PREFERRED EMBODIMENT

Figure 1:
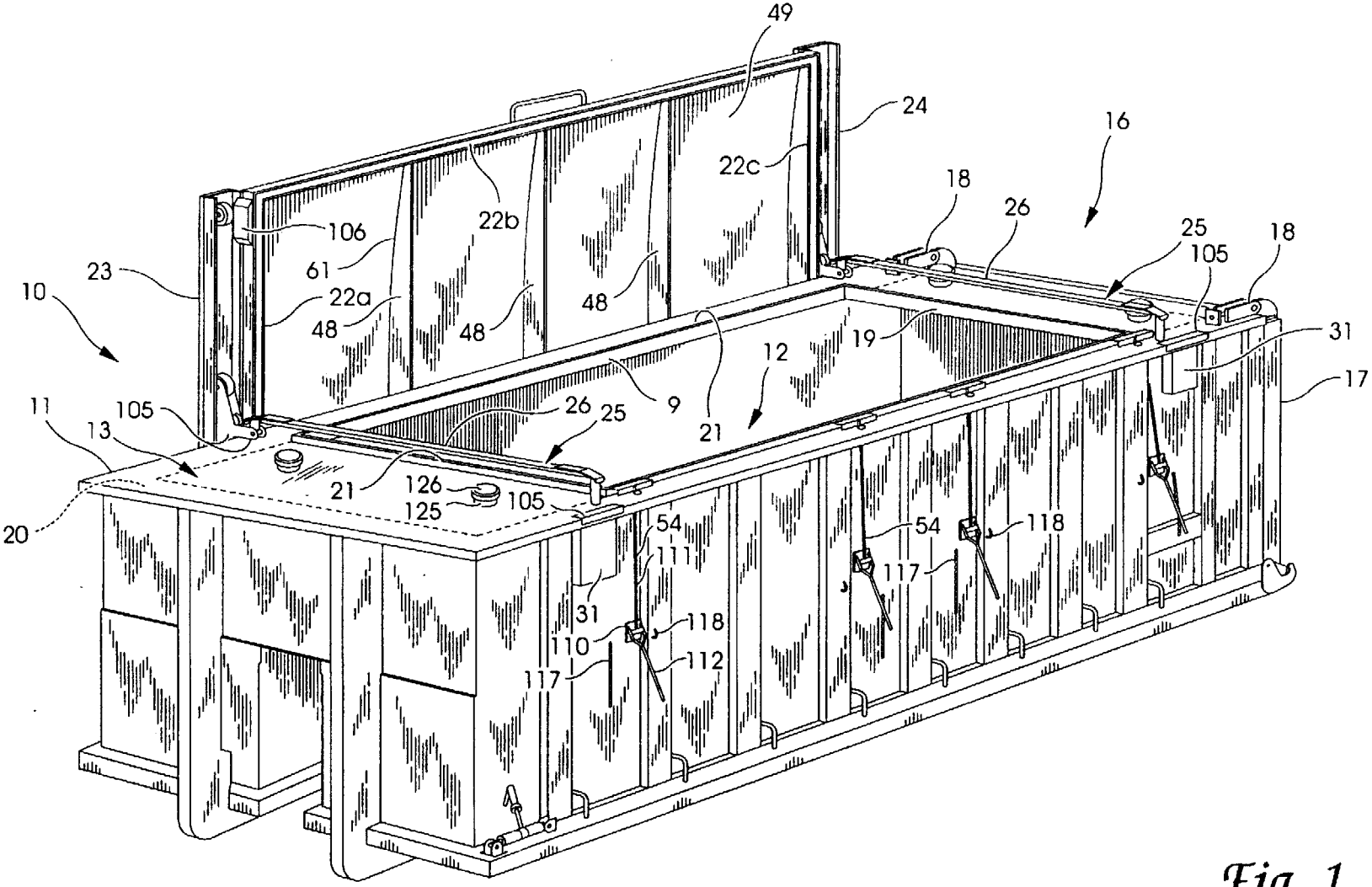
FIG. 1 is a perspective view of a waste handling container 10 with a sliding and pivoting lid 15 in accordance with the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 2:
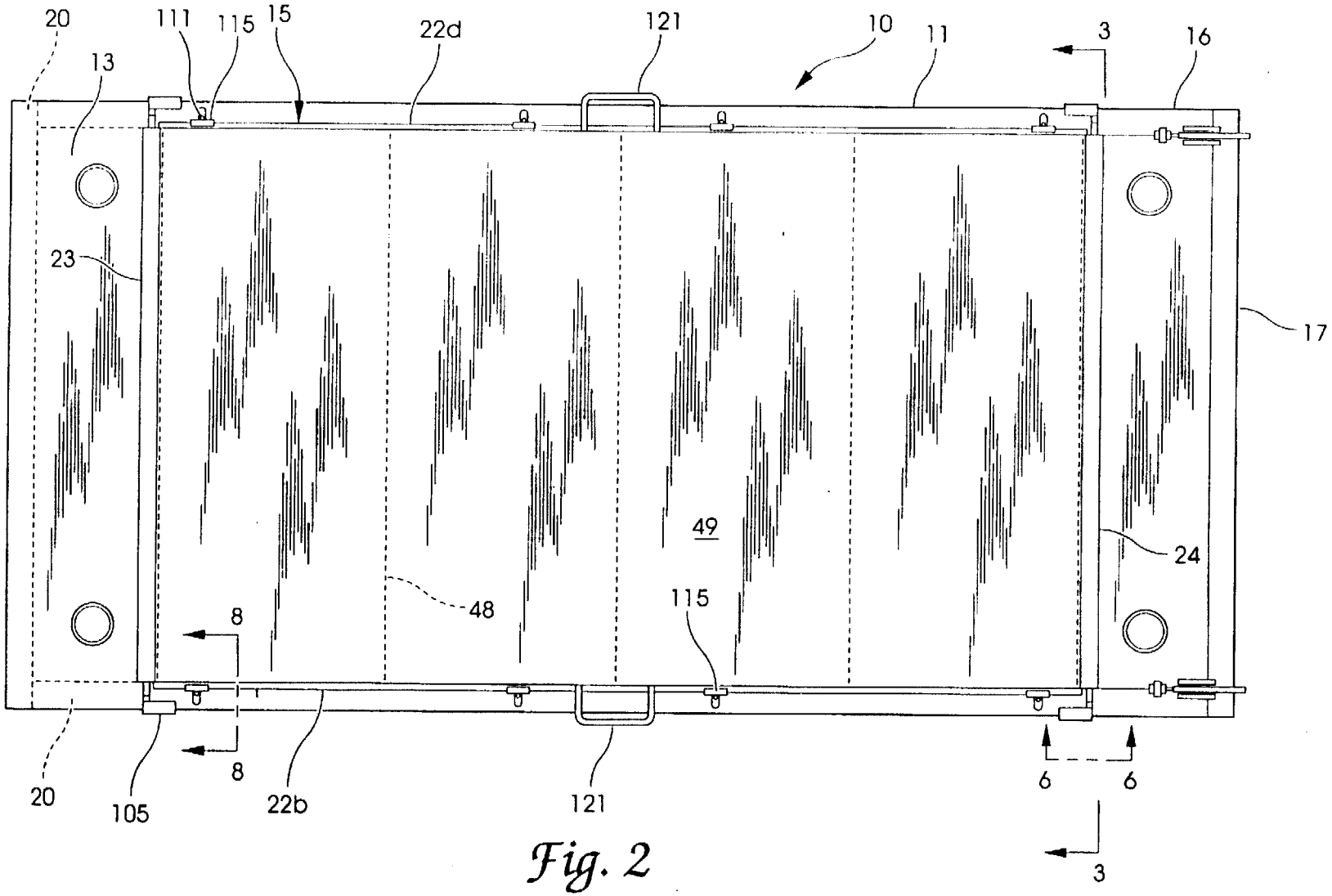
FIG. 2 is a plan view of the waste handling container 10 of FIG. 1 with the lid 15 in the closed and locked position.

Referring to FIGS. 1 and 2 there is shown a waste handling container 10 in accordance with the preferred embodiment of the present invention. Container 10 generally includes a container body 11 with a large rectangular-shaped opening 12 defined in its top 13; a sliding lid 15 to removably close off and seal opening 12; and, a door 17 hingedly mounted at hinges 18 to top 13 to sealably close off the one open end 16 of container body 11. Container 10 is adapted to sit on the ground with lid 12 pivoted to either side of container body 11 as shown in FIG. 1 and to receive waste materials through opening 12. When desired, lid 15 may easily be pivoted to a horizontal position and slid closed and locked down by one person, as described herein. Container 10 may then be safely transported to a disposal site where door 17 may be released and pivoted about hinges 18 to release the container contents.

Figure 3:
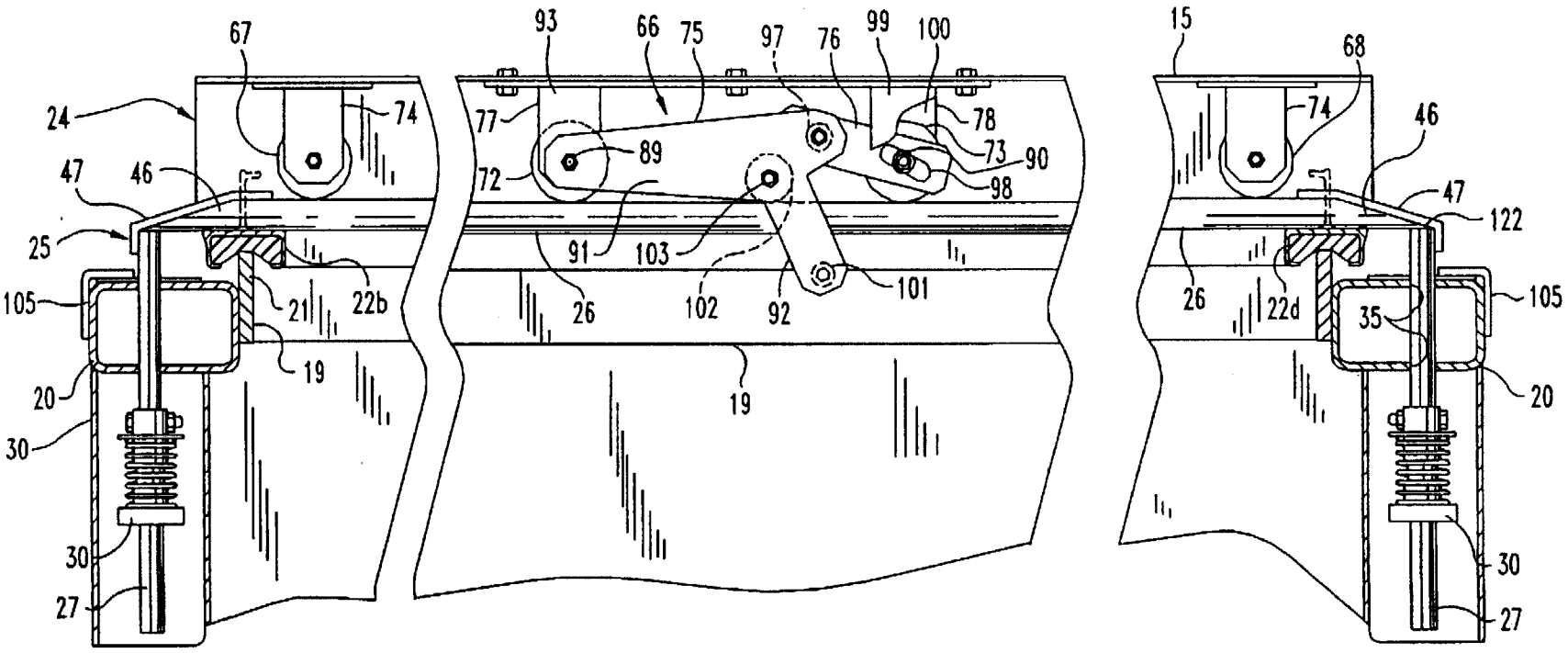
FIG. 3 is a fragmented cross-sectional view of the container 10 of FIG. 2 taken along the lines 3—3 and viewed in the direction of the arrows, with a portion of the container body 11 broken away to expose the sealing flange 21 and the channels **22*b* and 22*d* in cross-section, and with the lid 15** in the closed and clamped position.

Referring now to FIGS. 1—3, container body 11 generally includes a welded skeleton of rectangular cross-sectioned tubing with steel panels welded thereto. Included in the container skeleton are upper rectangular cross-sectioned tubing members 20 which extend around the periphery of and generally frame the top 13 of body 11. Four flat, bar stock members 19 are fixed together and to tubing members 20 to define rectangular opening 12 and to collectively form an upstanding rectangular sealing flange 21. Sealing flange 21 extends above tubing members 20 to permit full engagement with sealing channel 22 of lid 15, that is, so that sealing channel 22 does not contact the top of tubing members 20 when lid 15 and its sealing channels 22 are pulled downwardly into the sealed position.

Figure 6:
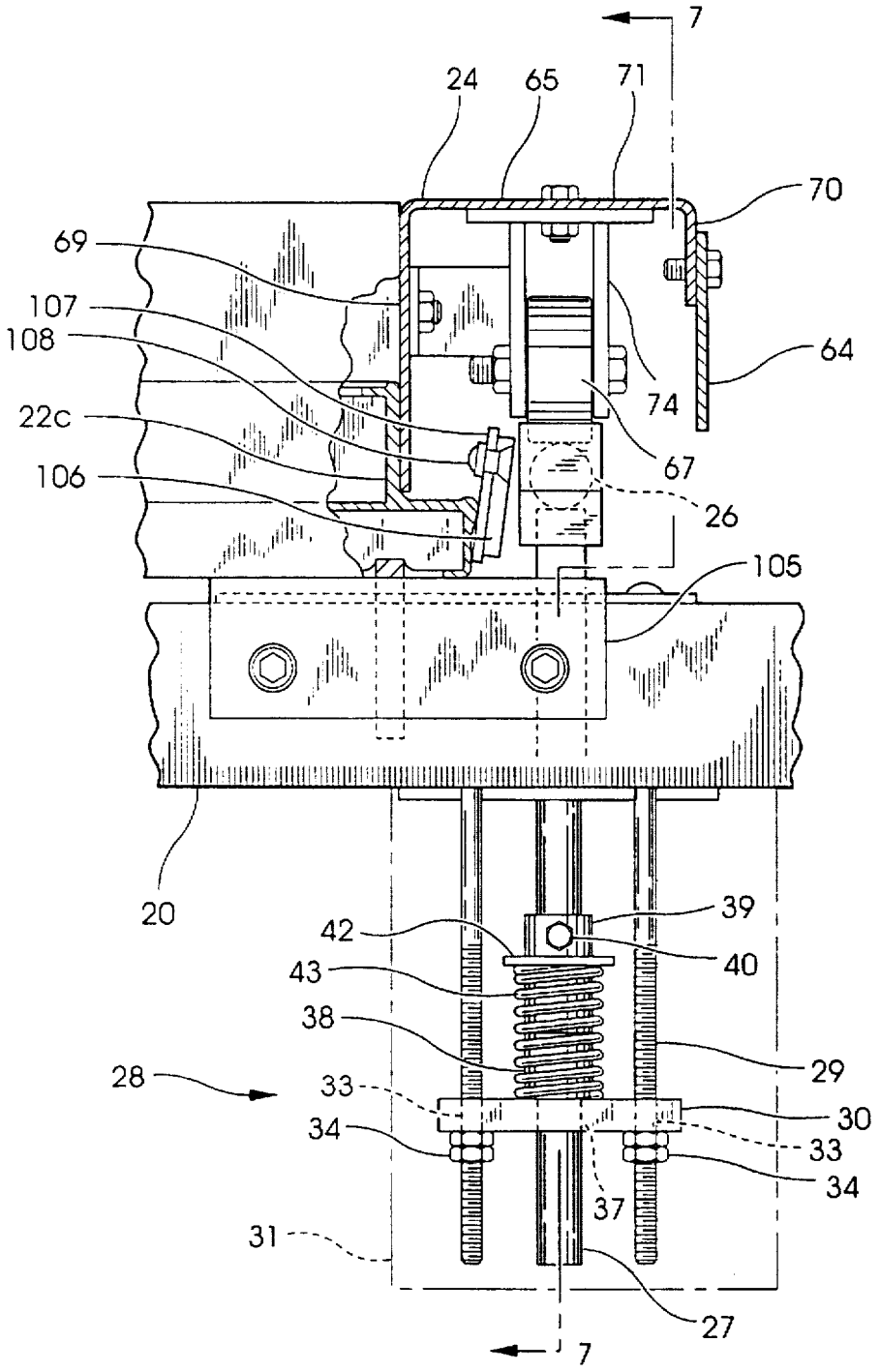
FIG. 6 is a cross-sectional view of the container 10 taken along the lines 6—6 of FIG. 2 and viewed in the direction of the arrows, with portions broken away for clarity.

Container 10 also includes a lid support assembly for holding, guiding, pivoting and generally enabling the nearly effortless opening and closing of lid 15. This lid support assembly includes a pair of guide rail assemblies 25 mounted to container body 11 at opposite sides of opening 12, and includes a corresponding pair of combination roller units 23 and 24 mounted at opposite ends of lid 15. The two guide rail assemblies 25 are identical and the following description will apply equally to both. Referring to FIGS. 1, 3, 6 and 7, assembly 25 includes a longitudinal tubular guide rail 26 supported at its opposite ends by and fixedly connected to posts 27. Posts 27 are mounted for vertical reciprocal movement relative to container body 11 by guide rail suspension units 28. Units 28 are mounted to and exteriorly of container body 11, but are enclosed by hingedly mounted cover boxes 31. Each suspension unit 28 includes a pair of spaced apart carriage bolts 29 which extend downwardly through holes in framing 20. A generally flat, rectangular spring base 30 has a pair of holes 33 spaced to enable base 30 to receive a corresponding pair of the bolts 29 therethrough as shown in FIG. 6. A pair of nuts 34 on each carriage bolt 29 supports base 30 and defines the position of base 30 relative to bolts 29 and to framing 20. Adjustment of nuts 34 thereby permits the position of base 30 to be vertically varied relative to framing 20. Each post 27 extends downwardly from its connection to guide rail 26, through holes 35 and 36 in framing 20, and through aligned hole 37 in base 30. A lower cylindrical collar 38 is rigidly secured atop spring base 30 and is coaxially aligned with hole 37 to surround post 27. An upper collar 39 is also cylindrical, surrounds post 27 above lower collar 38 and is adjustably fixed to post 27 as by a set screw 40. Upper collar 39 is sized larger than hole 36 of framing 20. The upper limit of travel of collar 39, and thus post 27 and rail 26 attached thereto, is thereby adjustably determined. Upper collar 39 also includes an outwardly extending annular flange 42 about midway along its height. A coil spring 43 encircles both collars 38 and 39 and extends vertically between flange 41 and spring base 30. Guide rail 26 and its posts 27 are thereby biased upwardly by the springs 43, but may be forced downwardly until upper collar 39 contacts lower collar 38 which is, of course, precluded from moving downward by base 30 and nuts 34. This downward limit is generally not reached in operation, however, because the downward movement of lid 15 will be limited by the engagement of sealing channel 22 with sealing flange 21 before collars 38 and 39 ever touch. Vertical adjustment of base 30 then serves to vary the spring force of spring 43 acting to bias guide rail upwardly. The sizing of collars 38 and 39, the positionment of upper collar 39 and the properties of spring 43 may all be selected as desired to upwardly support lid 15 at all stages of positionment thereof and to provide the desired resistance to closing and locking of lid 15 by locking clamps 54.

Figure 7:
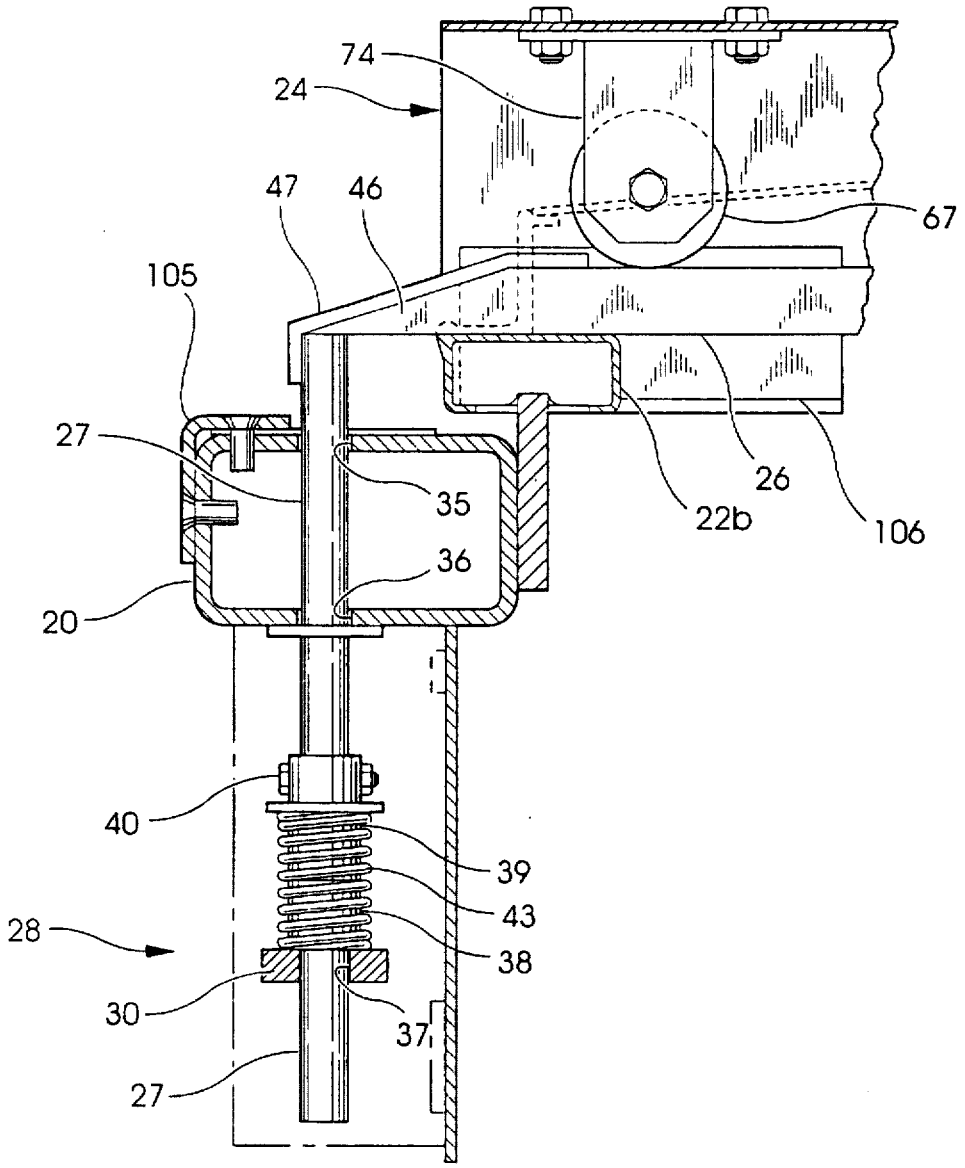
FIG. 7 is a cross-sectional view of the container 10 taken along the lines 7—7 of FIG. 6 and viewed in the direction of the arrows.

Guide rail 26 is a circular cross-sectioned pipe having beveled ends 46 which connect to their corresponding posts 27. Posts 27 both support guide rail 26 and form stops which engage with roller assemblies 66 as described herein. End caps 47 are fixedly secured to corresponding ends 46 of rail 26 and to the connecting posts 27. In one embodiment, as shown in FIG. 7, caps 47 follow the slope of the bevel of ends 46 at an angle of about 22°, and caps 47 have a thickness of one quarter inch, thereby providing a centering function for lid 15 as described herein.

Figure 8:
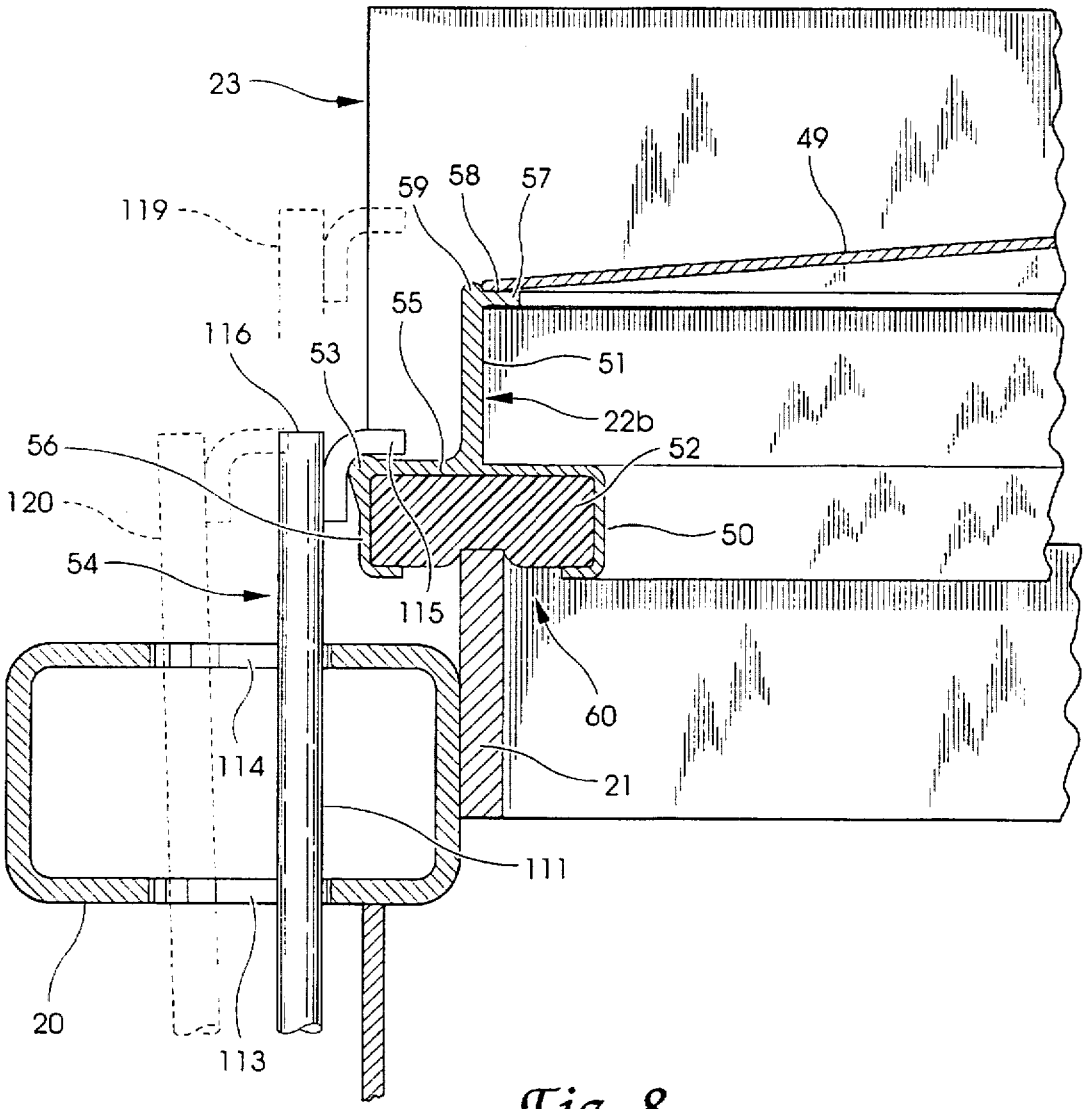
FIG. 8 is a cross-sectional view of a portion of the container taken along the lines 8—8 of FIG. 2 and viewed in the direction of the arrows.

Referring now to FIGS. 1, 2 and 8, lid 15 is generally composed of extruded sealing channels 22*a*–22*d*, arcuate lid panel supports 48, lid cover panel 49 and combination roller units 23 and 24. There are four longitudinal sections of extruded channels 22a–22d which are fixed together as by welding to form the rectangular frame of lid 15. Each channel 22a–22d generally includes a C-sectionX channel portion 50 and a rib portion 51 extending upwardly therefrom (FIG. 8). The C-sectionX channel portion 50 holds therein a resilient sealing gasket material 52 made of a rubber-type material appropriate for forming a tight sealing relative to the waste materials to be hauled. Selection of such an appropriate material is believed to be well known in the industry. Channel portion 50 defines a longitudinal opening 60 (approximately 1.75 inches wide in one embodiment) through which sealing flange 21 can extend and engage the gasket material 52 to tightly and safely seal lid 51 over opening 12.

At the upper and outer corner of channel portion 50, the thickness is increased to form a longitudinal bulbous edge 53 which runs at least at portions of, and preferably the entire length of, channel 22 to engage with a series of lid locking clamps 54. To enhance the strength of channel 22 during the lid hold-down and locking stages, the thickness of the entire upper segment 55, to the outside of rib portion 51, has been thickened. In one embodiment, where, over the greatest length of roughly 14 feet (channels 22b and 22d), the thickness of channel portion 50 to the inside of rib portion 51 is about 0.125 inches, and the inside dimensions of channel portion 50 measure approximately one inch high by two and one half inches wide, segment 55 has a thickness 50 percent greater than the remainder of channel portion 50 and a bulbous edge 53 which protrudes upwardly of segment 55 by approximately 0.066 inches and outwardly of outer side segment 56 by approximately 0.128 inches. This design is believed to enhance the torsional strength of channels 22a–22d, and thus lid 15, as well as the reliability of lid locking clamps 54. Near the top of rib portion 51, a longitudinal, lid panel support flange 57 extends inwardly and slightly upwardly therefrom, at an angle of approximately 94° from the rib portion therebelow. In one embodiment, flange support 57 extended outwardly from rib portion 51 to leave a gap of approximately 0.0974 inches between flange support 57 and the top 59 of rib portion 51, thereby leaving a longitudinal ledge 58 in each channel 22a–22d. Lid cover 49 is seated within the ledges 58 of the longer opposing channels 22b and 22d and fixed thereto as by welding. (FIG. 8). At the shorter opposing ends of lid 15, lid cover 49 is fixed as by welding to the inner, vertical sides of the two corresponding combination roller units 23 and 24. Between the ends of lid 15 and roller units 23 and 24, there are three spaced-apart, lid panel supports 48 which span the width of lid 15 (FIG. 1). Supports 48 are arcuate at their upper sides 61. Lid panel 49 rests atop and are welded to arcuate supports 48 with the edges of lid panel 49 fixed to opposing channels 22b and 22d and to combination roller units 23 and 24, as described above.

The two combination roller units 23 and 24 are themselves fixedly secured at opposite ends of lid 15 to channels 22a and 22c, respectively (FIG. 6). Units 23 and 24 are identical except where indicated and only one will be described herein. As shown in FIGS. 1 and 3–7, unit 24 includes a partially enclosing housing 65, a centrally located roller assembly 66 and a pair of end rollers 67 and 68. Housing 65 is a downwardly opening channel made of longitudinal sheet with a pair of right angle bends. The resulting housing includes a long inner side 69, a short outer side 70, and a top base 71 therebetween (FIG. 6). A flat longitudinal access plate 64 is bolted to short side 70 to partially cover roller assembly 66 and rollers 67 and 68, but is removable to permit access thereto for servicing. Housing 65 of roller unit 24 is fixedly secured in planar abutment to rib portion 51 of its corresponding sealing channel 22c at one end of lid 15 by appropriate means such as welding. Each end roller 67 and 68 is held for rotation by a roller bracket 74 which is fixed to both base 71 and inner side 69, as shown. Roller assembly 66 helps to support lid 15 upon guide rail 26 and operates in conjunction with guide rail 26 to permit lid 15 to hingedly pivot to either side of container body 11 as follows.

Figure 4:
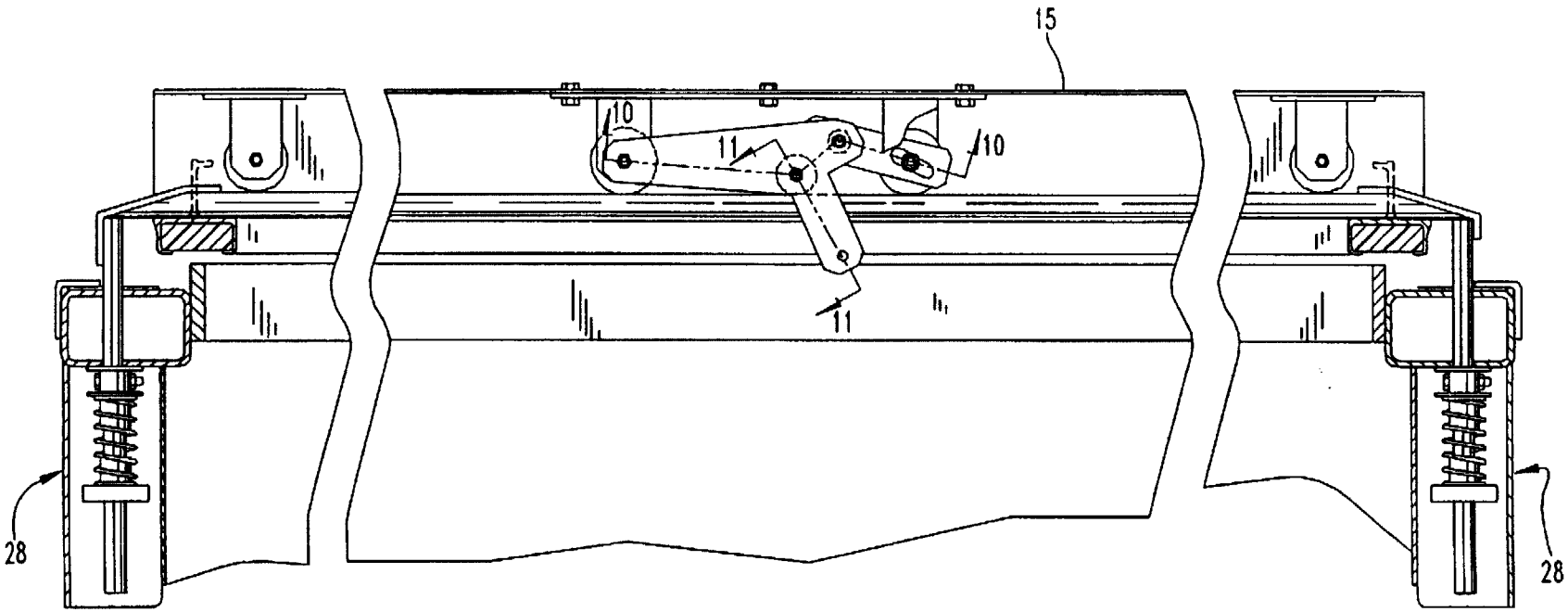
FIG. 4 is a fragmented cross-sectional view of the container 10 shown in FIG. 3, here showing lid 15 in the closed and unclamped position biased upwardly by the suspension units 28.
Figure 5:
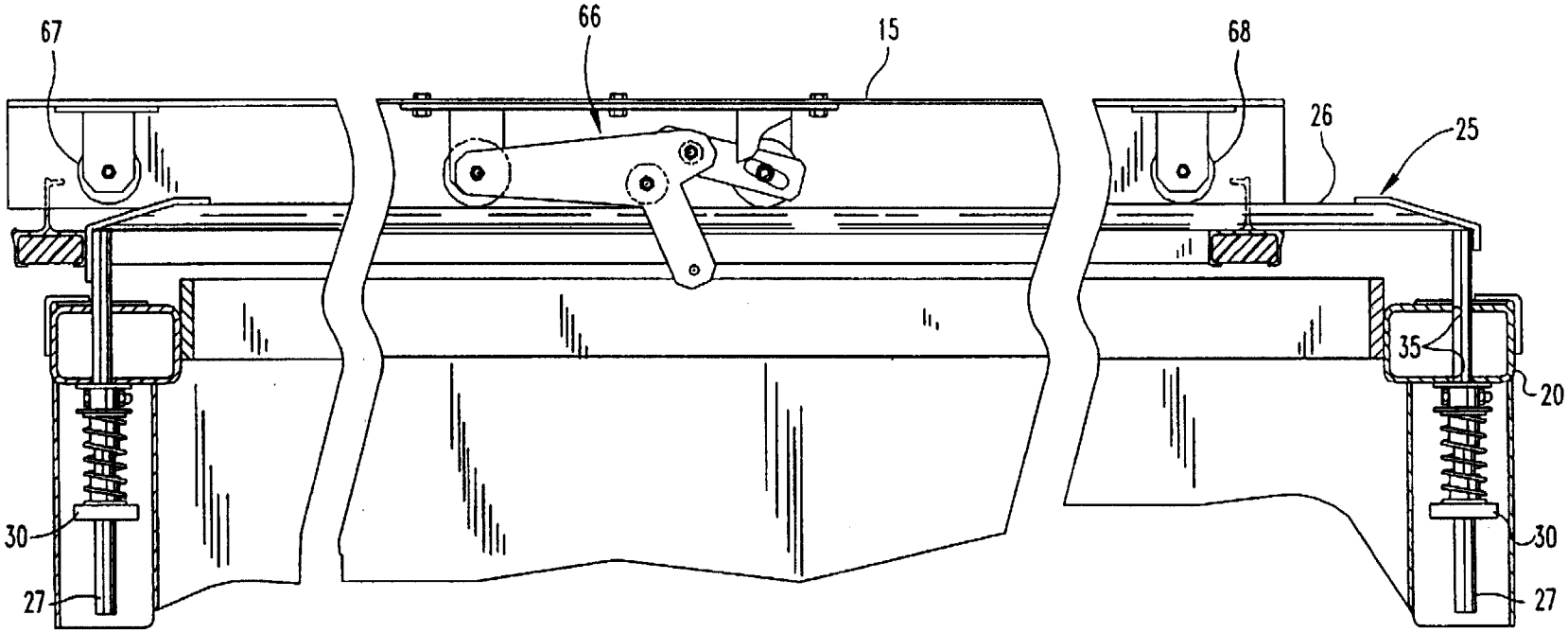
FIG. 5 is a fragmented cross-sectional view of the container of FIG. 4, here showing lid 15 positioned laterally along guide rail 26 from the closed and unclamped position.
Figure 9:
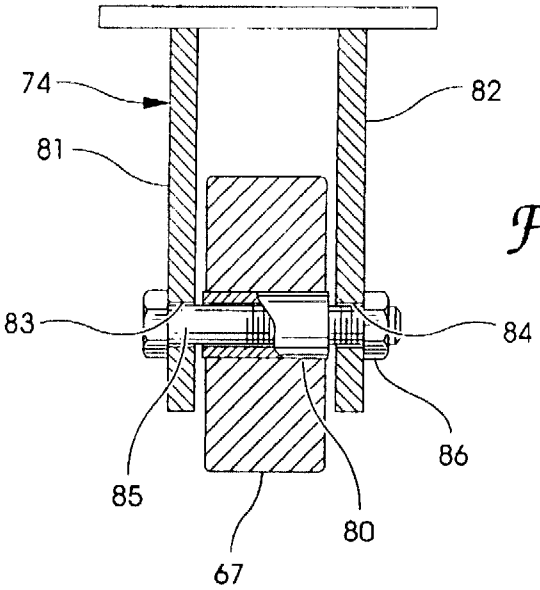
FIG. 9 is a cross-sectional view of one of the end rollers 67 and roller brackets 74.

Referring to FIGS. 3–5, roller assembly 66 includes a pair of support rollers 72 and 73 which are mounted to top base 71 by brackets 77 and 78, respectively and includes a pivot link 75 and a connecting link 76. Brackets 77 and 78 hold their corresponding rollers 72 and 73 for rotation about axles 89 and 90 in a manner similar to the way brackets 74 hold their end rollers 67 and 68. That is, referring to roller 67 as shown in FIG. 9, a pipe member 80 extends through a central passageway in roller 67 and between the pair of downwardly extending bracket arms 81 and 82 of the bracket 74. A bolt 85 extends through aligned holes 83 and 84 in bracket arms 81 and 82, respectively, and through pipe member 80 and roller 67 to form an axle therewith. A nut 86 secures bolt 85 in place. The combination of all of rollers 67 and 68 and the rollers 72 and 73 of roller assembly allow lid 15 to effectively "slide" atop container body 11.

Figure 11:
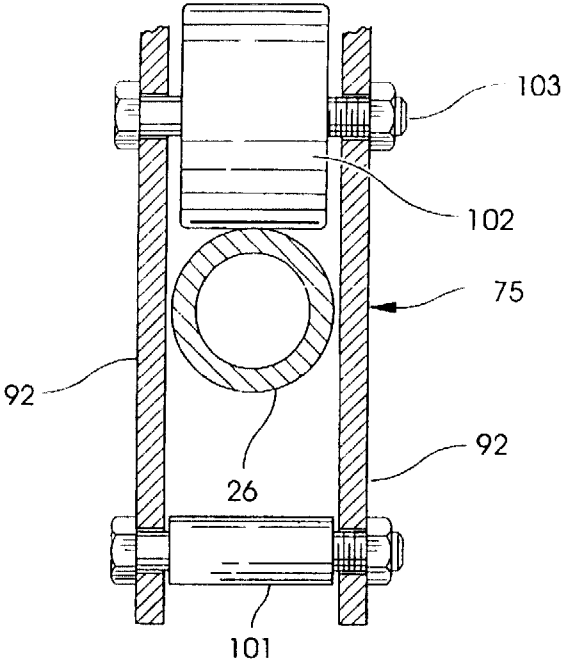
FIG. 11 is a cross-sectional view of a portion of roller assembly 66 taken along the lines 11—11 of FIG. 4 and viewed in the direction of the arrows.
Figure 10:
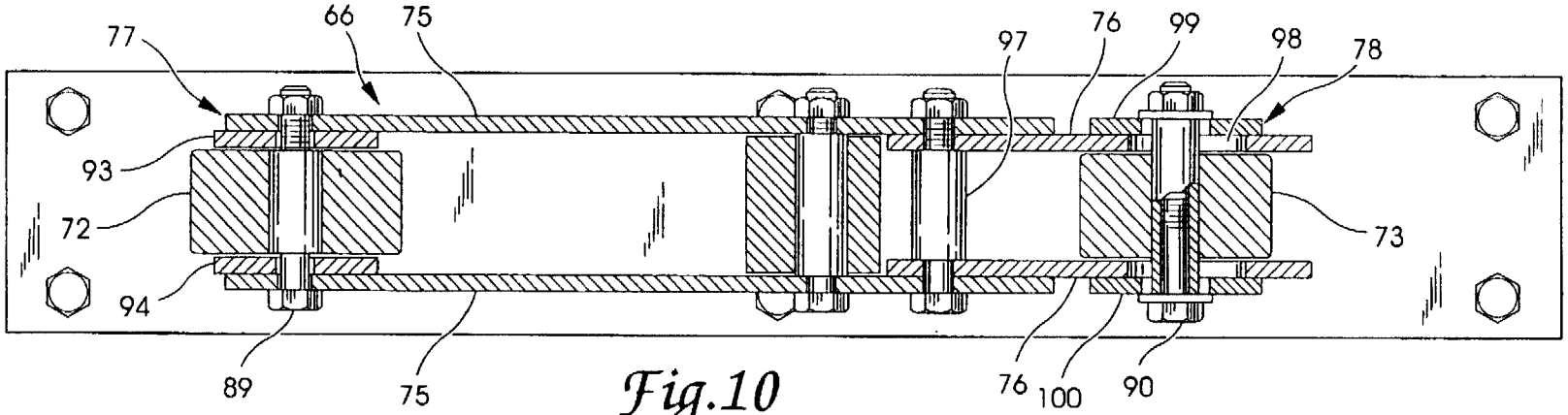
FIG. 10 is a bottom cross-sectional view of roller assembly 66 taken along the lines 10—10 of FIG. 4 and viewed in the direction of the arrows.

Pivot link 75 is actually two identically shaped pivot links 75 (FIGS. 3 and 10), each including a central body portion 91 and a retaining arm 92. The two pivot links 75 are each pivotally mounted at one of their ends to the axle 89 of roller 72, outside of the opposing, downwardly extending bracket arms 93 and 94 of bracket 77. Likewise, connecting link 76 is actually two identically shaped connecting links 76 which are pivotally connected at one of their ends by hinge pin 97 to corresponding links 75 and are pivotally and slidably connected at their opposite ends to axle 90 of roller 73. The combination pivoting and sliding movement of links 76 relative to axle 90 is achieved by a slot 98 defined in each link 76 and through which axle 90 extends with the two links 76 juxtaposed outside of roller 73 and inside of the corresponding, downwardly extending bracket arms 99 and 100 of bracket 78. Bracket arms 99 and 100 are generally coplanar with pivot links 75, and bracket arms 93 and 94 are generally coplanar with connecting links 76. The two retaining arms 92 of pivot links 75 extend downwardly therefrom at an angle and on opposite sides of guide rail 26 (FIGS. 3 and 11). A pin 101 extends between and is fixed to the two arms 92 below guide rail 26. An auxiliary support roller 102 is rotatably supported between pivot links 75 by an axle 103 at roughly the intersection between central body portion 91 and retaining arm 92. With this configuration, roller assembly 66 is essentially locked to guide rail 26 at all times. Thus, lid 15 and its rollers 67, 68, 72 and 73 may be lifted only a short distance away from guide rail 26 before pin 101 engages the bottom of guide rail 26. Links 75 and 76 of roller assembly 66 may then pivot somewhat (about axles 89 and 90 and pin 97) to permit an additional degree of movement of lid 15 upwardly from guide rail 26; however, a limit is ultimately reached where lid 15 can be lifted no more. As defined herein, the present configuration of roller assembly 66 and guide rail 26 also defines the limits of lateral movement of lid 15. As a result, lid 15 is held fairly securely to move only along rails 26 as described below. While the weight of lid 15 alone would be adequate to keep lid 15 resting atop guide rail 26, a heavy wind gust could easily lift lid 15 up and off of container body 11. The present configuration of guide rail 26 and roller assembly 66 with pin 101 prevents this from happening.

A set of four, L-shaped, nylon, wear strips 105 (FIGS. 1, 3, 6 an 7) are secured on both sides of container body 11 to tubular framing 20 at positions appropriate to engage with each of the two roller assemblies 66 during the pivoting action of lid 15 as described below. Two nylon bearing pads 106 (FIGS. 1, 6 and 7) are fixed to the outer sides of the channel portions 50 of each of the end sealing channels 22*a* and 22*c* of lid 15. Each bearing pad 106 is secured to a mounting plate 107 by recessed screws 108, and each mounting plate 107 is secured as by welding to its corresponding channel 22*a* or 22*c*. The two pads 106 of each channel 22*a* and 22*c* are spaced mutually apart so that there is a paid at each corner of lid 5, as seen in FIG. 7. In addition to this positionment, pads 106 are sized relative to the corresponding components to engage the corresponding guide rails 26 when necessary to assure that lid 15 remains on track on guide rails 26.

Referring to FIGS. 1 and 8, there are four, identical locking clamps 54 on each side of container body 11. Each clamp 54 includes a fulcrum lever arrangement 110 (FIG. 1), as is well known in the art, which allows a rod 111 to be drawn a short distance downward with great force through movement of a hand lever 112 with application of little force. Lever arrangement 110 is preferably of the type permitting adjustment of the position and/or stroke of rod 111. Rod 111 extends from lever arrangement 110 up through slots 113 and 114 defined in tubular framing 20. A hook member 115 is secured as by welding at the top 116 of rod 111 and above tubular framing 20. Hook 115 of each clamp 54 is thereby adapted to engage and lock with a corresponding section of bulbous edge 53 of channels 22*b* and 22*d*. A chain and hook combination is provided to secure each locking clamp 54 in the locked position to ensure that locking clamps 54, and thereby lid 15, stay locked down during transport.

In operation, lid 15 is opened and sealably closed as follows:

FIG. 3 shows lid 15 in the closed and clamped position where the eight clamps 54 are lockingly engaged with the corresponding sealing channels 22*b* and 22*d*, and sealing channels 22*a*–22*d* and their gaskets 52 are sealingly engaged with the upstanding sealing flange 21. To unlock lid 15, each chain 117 is released from its hook 118 and hand lever 112 is pivoted upwardly which moves rod 111 and its hook 115 to an upwardly disengaged position indicated at 119 in FIG. 8. In this position, hook 115 is high enough to be totally disengaged from and spaced above the corresponding channel 22*b* or 22*d* and rods 111 and their hooks 115 then may be pivoted outwardly within slots 113 and 114 and completely clear of lid 15 while hand levers 112 are pivoted back down, which pulls the corresponding rod 111 to a downward and outward disengaged position at 120. As each clamp 54 is disengaged from lid 15, suspension units 28 bias guide rails 26, and lid 15 riding thereupon, upwardly to the limit defined by upper collars 39, which are secured to posts 27. With all of rod 111 and hooks 115 outwardly clear of lid 15, suspension units 28 have raised lid 15 to a closed and unclamped position (FIG. 4) upwardly clear of sealing flange 21 and above the top 116 of each rod 111. One of two handles 121 on either side of lid 15 may then be grasped and pulled, which moves lid 15 laterally to that side along guide rails 26 (FIG. 5).

Figure 12:
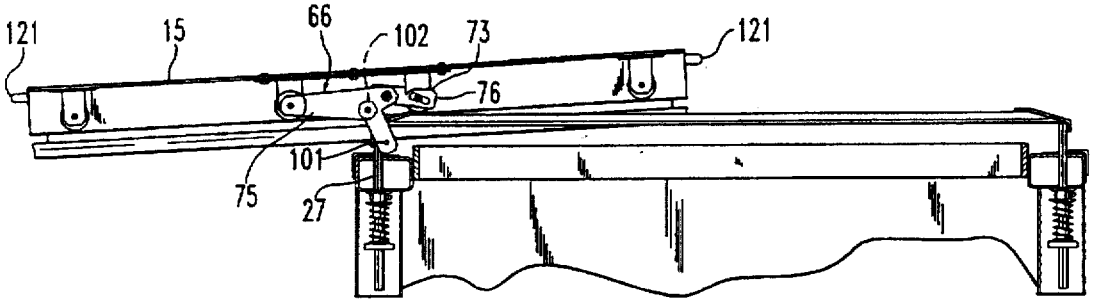
FIGS. 12–14 are side, cross-sectional views similar to those of FIGS. 3–5 showing the pivoting motion of lid 15 to its vertical resting position alongside container body 11.
Figure 13:
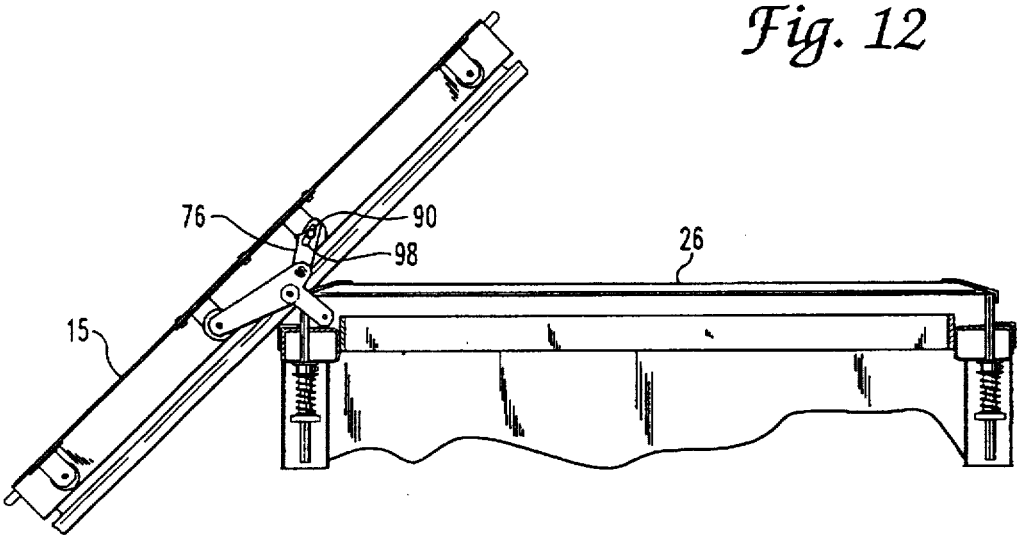
Figure 14:
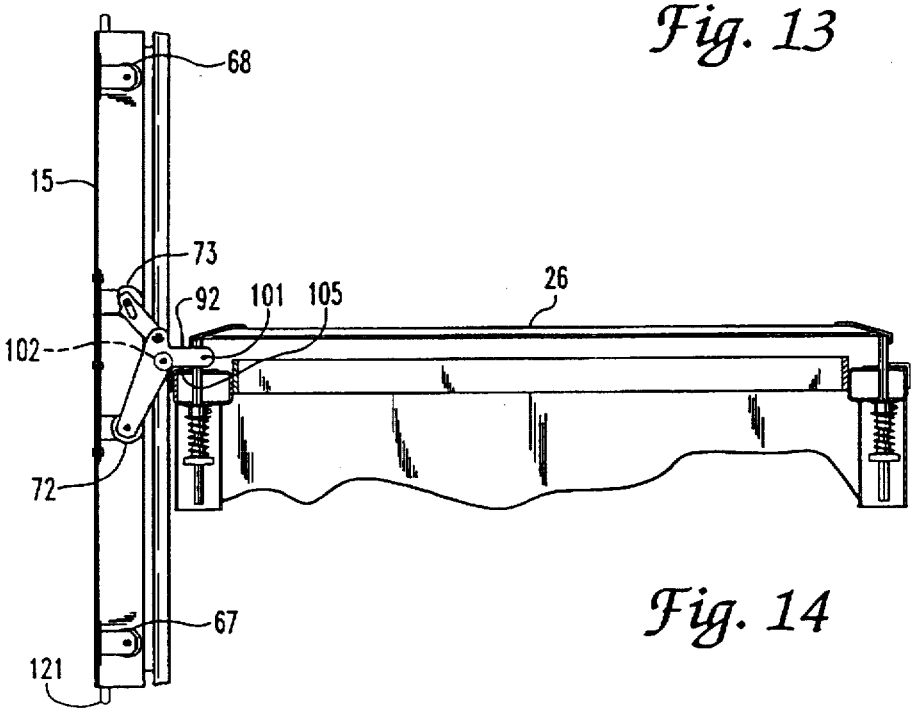

When lid 15 has moved roughly half its distance to one side, the two pins 101 on each roller assembly 66 will contact the corresponding posts 27, as shown in FIG. 12, at which point lid 15 stops moving laterally and is then pivoted roughly about the innermost roller of roller assembly 66 (here, roller 73) and auxiliary support roller 102. The action of pivot link 75 and connecting link 76 provide sufficient play to ensure clearance for the pivoting lid 15 as it pivots over the edge of the container body. The configuration, sizing and placing of roller assembly 66 and its rollers 72 and 73 is such that lid 15 is fairly well balanced as it pivots at this one end of container body 11 so that the operator grasping handle 121 can fairly easily lower the end of lid 15 that he or she is holding as it pivots (FIG. 13) through roughly a 90° angle to the open and resting position shown in FIG. 14. As seen from FIGS. 12–14, the connecting link 76 moves somewhat laterally by virtue of its slot 98 and axle 90 to the extreme shown in FIG. 14, at which point lid 15 is generally supported by the retaining arm 92 of pivot link 75 resting on nylon wear strips 105. In one embodiment, the relative dimensions of the components, specifically of roller assembly 66, are as shown in FIGS. 3–5 and 12–14, this particular configuration providing a smooth sliding and pivoting operation of lid 15.

To close and seal lid 15, the reverse procedure is generally performed. That is, handle 121 is grasped and lifted to pivot lid 15 generally about pin 101. When lid 15 has substantially reached a horizontal position, the operator pushes lid 15 to slide it completely atop container 11. The ramped configuration of end caps 47 facilitate the engagement of rollers 73, 102, 72 and 67 as they contact guide rail 26. As referred to above, end caps 47 have a thickness such that, as the operator pushes lid 15 toward a closed position, the leading end roller (here, roller 68) reaches the corresponding far end cap 47 (here, designated as 122 in FIG. 3), and engages it. When roller 68 hits end cap 122, the operator can "feel" the contact and then knows that the lid has reached a position between the two end caps 47 as shown in FIG. 3. With lid 15 thus centered, the operator engages each clamp 54 by lifting the corresponding hand lever 112, positioning rod 111 and its hook 115 over and against corresponding bulbous edge 53, and then lowers handle 112 all the way down to pull lid 15 and its sealing channels 22*a*–22*d* tightly against sealing flange 21. Chains 117 are then firmly positioned around their corresponding handles 112 and are attached to their hook 118, which thus prevents handles 112 from flipping up during transport.

Container body 11 is also provided with a number of air vents 125 with screw caps 126 which can be partially or completely removed to enable the release of pressurized gases which may build up while lid 15 is closed.

The opening, closing and clamping operation of door 17 at the end 16 of container 11, as well as the loading, transport and unloading of container 10 are believed to be well known in this art and are not described herein.

Figure 15:
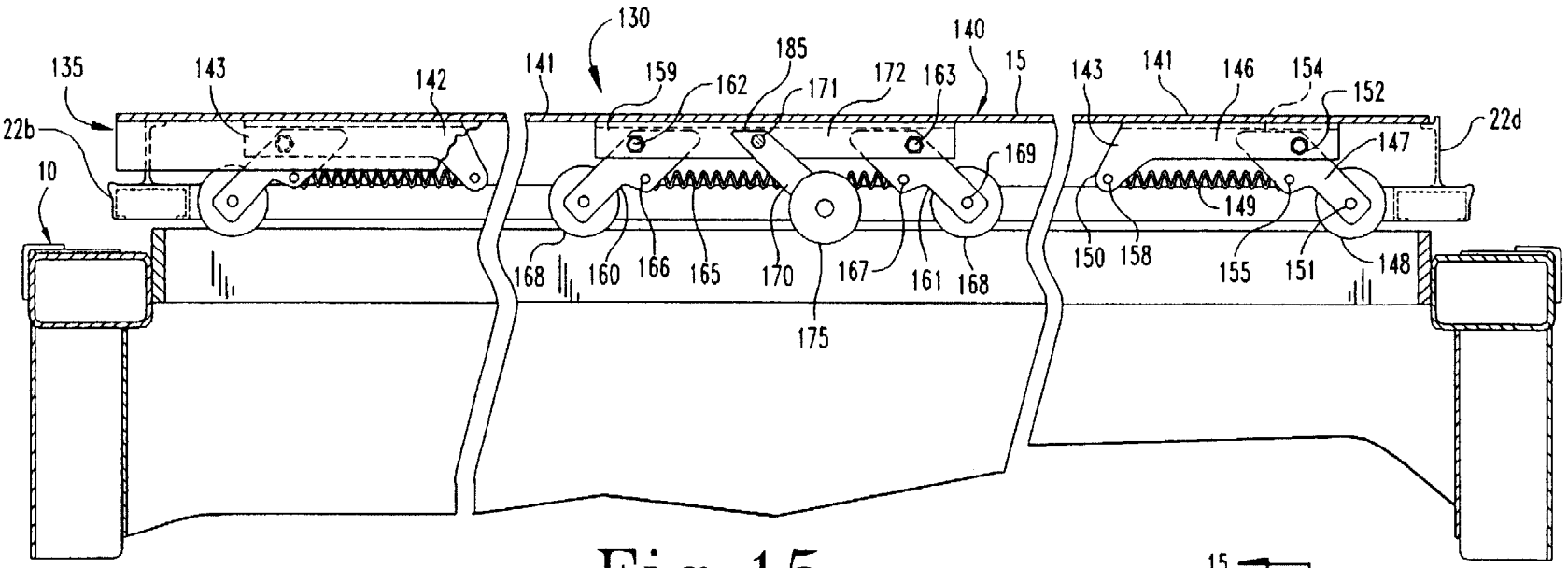
FIG. 15 is a fragmented cross-sectional view of an alternative embodiment of the container 10 of FIG. 2 taken along the lines 3—3 and viewed in the direction of the arrows, with a portion of the container body broken away to expose the sealing flange 21 and the channels 22*b* and 22*d* in cross-section, and with lid 15 in the closed and unclamped position biased upwardly by the spring loaded roller assemblies.
Figure 16:
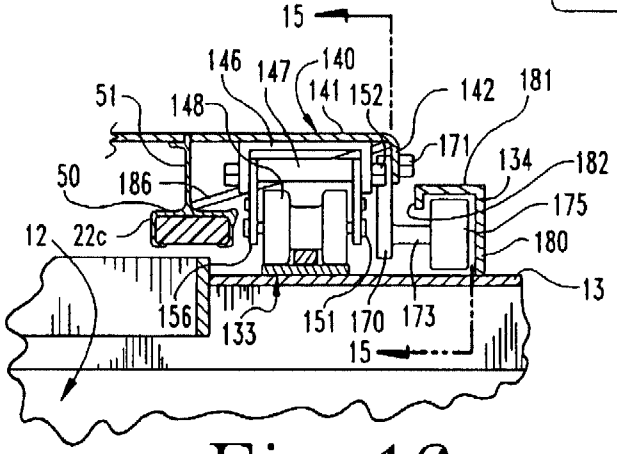
FIG. 16 is a cross-sectional view of the an alternative embodiment of the container 10 of FIG. 2 taken along the lines 6—6 and viewed in the direction of the arrows, with portions broken away for clarity and corresponding to the container shown in FIG. 15.
Figure 17:
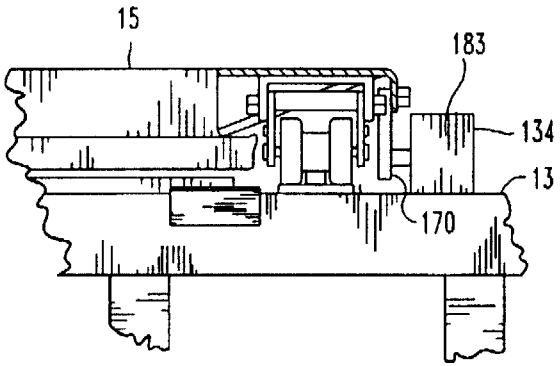
FIG. 17 is a side elevational view of the portion of the container shown in FIG. 16.

In another embodiment shown in FIGS. 15 through 17, there is shown a lid support assembly 130 for supporting a container lid 15 for sliding and pivoting movement relative to the container 10. In relation to the container 10 of FIGS. 1–14, lid support assembly 130 of FIGS. 15 and 16 includes a pair of guide rails 133 and a pair of guide channels 134 fixed to the top 13 of container 10, at opposite ends of opening 12, and in place of guide rail assemblies 25. Lid support assembly 130 further includes a pair of combination roller units 135 mounted to and at opposite ends of lid 15 in place of roller units 23 and 24. As with the guide rail assemblies 25 and combination roller unit 23 and 24 of FIGS. 1–14, the pairs of guide rails 133, guide channels 134 and roller units 135, at opposite sides of opening 12 and lid 15, are essentially mirror images of each other and description of only one member of any of the three pairs will be understood to apply to the corresponding other of the pair.

Combination roller units 135 extend outwardly from each end of lid 15, just outside of sealing channels 22a and 22c. Sealing channels 22a–22d have roughly the same configuration as described in prior embodiments except that lid 15 is constructed to have a lower profile. Combination roller unit 135 includes a housing 140 with a head plate 141 extending horizontally outwardly from the side of lid 15. Head plate 141 angles downwardly at its outboard edge to form a side plate section 142. A pair of spring-loaded, outer roller assemblies 143 are mounted to the underside, and at opposing ends of head plate 141 so that there is essentially a roller assembly 143 at each of the four corners of lid 15. Each roller assembly 143 includes a downwardly opening, C-shaped mounting bracket 146, a roller mounting fork 147 pivotally mounted to one end of bracket 146, an end roller 148 rotatably mounted at pin 151 to fork 147, and a spring 149. Bracket 146 defines a downwardly extending spring-mounting portion 150 opposite the end where fork 147 is mounted. Fork 147 is pivotally mounted at its upper portion to bracket 146 via a pin 152. Fork 147 defines a pivot stop surface 154 which is configured to engage with the underside of bracket 146 and to permit fork 147 to pivot only outwardly (counterclockwise but not clockwise for the fork 147 on the right in FIG. 15) from its rest position (also shown in FIG. 15). Roughly midway between pin 151 and pin 152, and, like pins 151 and 152, third pin 155 is held by and between the arms 156 of fork 147. Spring 149 extends in tension between pin 155 and a pin 158 held by portion 150 to bias roller-mounting fork 147 to the rest position shown in FIG. 15.

A spring-mounted, center roller assembly 159 is mounted to the underside of head plate 141, roughly midway between the outer two roller assemblies 143. Assembly 159 is similar in structure to the outer roller assemblies 143, except that it has pivotally mounted thereto a mirror image pair of roller mounting forks 160 and 161 configured to mutually or individually pivot only outwardly from their rest positions shown in FIG. 15. That is, fork 160 can pivot only clockwise and fork 161 can pivot only counterclockwise from the shown rest positions about their pivot pins 162 and 163, respectively. A spring 165 extends in tension between forks 160 and 161 at the spring mounting pins 166 and 167, respectively, to pull forks 160 and 161 together to their respective rest positions. Rollers 168 are rotatably mounted at the outboard ends of forks 160 and 161 by pins 169. Follower arm 170 is pivotally mounted at one end via pin 171 to the center roller bracket 172, pin 171 being between pins 162 and 163. Arm 170 includes an axle member 173 extending generally orthogonally outwardly therefrom. A follower roller 175 is rotatably mounted at the outboard end of axle member 173. Arm 170 is configured and mounted to bracket 172 so that roller 175 is roughly midway between rollers 168, as viewed in FIG. 15.

Rail 133 has an inverted, T-shaped cross-section and is fixedly mounted to the top 13 of container 10 just outside of opening 12 in a position aligned below the rollers 148 and 168 so that lid 15 will be centered over opening 12. The inverted T-shape of rail 133 is formed by a flat base plate 177 and a narrower-width guide bar 178 centeredly fixed thereatop. Each of rollers 148 and 168 is grooved to engage with and strictly follow the inverted, T-shape rail 133, as shown in FIG. 16.

Guide channel 134 has a hook-shaped cross-section and runs the width of container 10, alongside of rail 133. The long vertical 180, top horizontal 181 and inside short vertical 182 sides, which form the hook-shaped cross-section of channel 134, sufficiently enclose follower roller 175 so that roller 175, strictly follows channel 134 and rollers 148 and 168 strictly follow guide rails 133.

At each end of channel 134 is an end plate 183 fixedly connected thereto to constrain roller 175 to stay within guide channel 134, and not to roll outside of either end thereof. Braces 186 extend as needed between channels 22a and 22c and the corresponding housing 140 (as shown in FIG. 16) to provide support and more rigidly connect housings 140 to lid 15. Each brace 186 is welded to and extends generally from the junction of the channel portion 50 and rib portion 51 to the junction of head plate 141 and side plate section 142.

As with forks 147, follower arm 170 defines a pivot stop surface 185 at its top to constrain arm 170 to pivot only from the rest position (shown in FIGS. 15 and 16) counterclockwise (as viewed in FIG. 15). Because arm 170 cannot pivot (clockwise in FIG. 15) beyond its rest position, and because roller 175 cannot rise above the top horizontal side 181, lid 15 is precluded from rising farther than is shown in FIG. 15. Because springs 149 and 165 pull forks 147, 160 and 161 about their respective pins 152, 162 and 163, lid 15 is biased upwardly from container 10 and from sealing engagement with sealing flange 21, but only to the limited height permitted by the top side 181 via follower arm 170. When it is desired to close lid 15, the locking clamps 54 are engaged, as described in prior embodiments, to pull lid 15 into tight sealing engagement with container 10. When lid 15 is thus pulled onto container 10, forks 147, 160 and 161 pivot about their pins 152, 162 and 163, respectively, against the bias of their springs 149 and 165. When clamps 54 are released, springs 149 and 165 pull forks 147, 160 and 161 back to their rest positions (FIG. 15) to raise lid 15 clear of sealing flange 21. Lid 15 may then be pushed by one person parallel to guide rails 133, with rollers 148 and 168 strictly following guide rails 133.

Lid 15 pivots in a manner similar to the lid 15 of FIG. 1. When lid 15 is pushed or pulled to one side roughly one half its width, rollers 175 engage with and are stopped by the corresponding end plates 183 of guide channels 134. Lid 15 may then be pivoted, similarly to that shown in FIG. 1, about rollers 175 until lid 15 has rotated about 90° to its open position against the side of container 10.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A lid assembly for a container, the container having sides, a top and an upwardly facing opening in the top, the lid assembly comprising:

a lid member having a width and being sized to cover and seal shut the opening;

means for mounting said lid to the container including a pair of guide rails mountable to the top of the container and at least one guide channel mountable to the top of the container;

a plurality of rollers mounted to and at opposite ends of said lid member, said rollers being sized, configured and positioned to ride upon and follow said guide rails;

at least one follower roller mounted to said lid member to one of the inside and the outside of said plurality of rollers, said follower roller being sized, configured and positioned to follow and stay operably engaged with said at least one guide channel; and, wherein said guide rails and plurality of rollers and at least one guide channel and at least one follower roller all mutually coact to permit said lid member to be moved between a closed and clamped position wherein said lid member is positioned over and tightly clamped to the container to seal shut the opening and a closed and unclamped position wherein said lid member is positioned over the opening but is free to be slid laterally along said guide rails, and to permit said lid member to be moved between the closed and unclamped position and an open position wherein said lid member is positioned away from the opening along either side of the container.

2. The lid assembly for a container of claim 1 wherein said plurality of rollers are pivotally mounted to said lid member to permit said lid member to move between the closed and clamped position and the closed and unclamped position while said plurality of rollers stay in contact with said guide rails.

3. The lid assembly for a container of claim 2 wherein said plurality of pivotally mounted rollers are spring biased to bias said lid member to the closed and unclamped position from the closed and clamped position.

4. The lid assembly for a container of claim 3 wherein each of said guide rails has an inverted-T cross-sectional shape and each of said plurality of rollers is centrally grooved to complementarily engage with the inverted-T shape of said guide rails.

5. The lid assembly for a container of claim 3 wherein said lid member has opposing first and second sides, each side having opposing ends, and wherein said plurality of rollers includes one roller mounted for rotation at each end of each of said first and second sides.

6. The lid assembly for a container of claim 5 wherein said at least one follower roller is mounted for rotation to one of the sides of said lid member, roughly midway between the ends of said one of the sides, to engage with said at least one guide channel.

7. The lid assembly for a container of claim 5 wherein said plurality of rollers further includes at least one pair of additional rollers spaced apart from each other and aligned to follow the corresponding guide rail, said at least one pair of additional rollers being pivotally mounted to one side of said lid roughly midway between the ends of said each side.

8. The lid assembly for a container of claim 7 further including roller mounting brackets mounted to said lid member for holding said plurality of rollers and including roller mounting forks having opposing inboard and outboard ends, each of said forks being pivotally mounted to said one of said brackets at an inboard end of said fork, and wherein each of said plurality of rollers is mounted for rotation to an outboard end of one of said forks.

9. The lid assembly for a container of claim 8 further including, for each of said one roller mounted for rotation at each end of each of said first and second sides, a spring mounted in tension between the bracket and the corresponding fork to bias the fork to pivot its one roller away from said lid member.

10. The lid assembly for a container of claim 9 wherein each of said forks defines a pivot stop surface which engages with its corresponding bracket to limit the degree to which said fork can pivot away from the bias of the corresponding spring.

11. The lid assembly for a container of claim 9 further including, for said at least one pair of additional rollers spaced apart from each other, a spring mounted in tension between the forks of said additional rollers to bias the forks of said pair of additional rollers to pivot their rollers toward each other and away from said lid member.

12. The lid assembly for a container of claim 6 wherein there are two of said at least one guide channels and two of said at least one follower rollers, said guide channels each having opposing ends with end plates, and wherein said follower rollers and guide channels are sized and configured so that when said lid member is moved laterally roughly half its width from the closed and clamped position along said guide rails, said follower rollers engage with said end plates, stop such lateral movement and permit said lid to be pivoted about said follower rollers until said lid is in the open position.

13. A lid assembly for a container, the container having a top and an opening defined in the top, the opening having opposing sides, the lid assembly comprising:

a lid member sized to cover the opening and having opposing ends and a width;

means for mounting said lid to the container including a pair of guide rails mountable to the top of the container outside of the opposing sides of the opening and at least one guide channel mountable to the top of the container to one of the inside or the outside of and substantially horizontal with one of the pair of guide rails;

a plurality of rollers mounted for rotation to the opposing ends of said lid member, said rollers being sized, configured and positioned to ride upon and follow said guide rails;

at least one follower roller mounted to said lid member, said at least one follower roller being sized, configured and positioned to follow and stay operably engaged with said at least one guide channel; and wherein said guide rails and plurality of rollers and at least one guide channel and at least one follower roller all mutually coact to permit said lid member to be moved between a closed position wherein said lid member is positioned over and held tightly against the container to close off the opening and an intermediate position wherein said lid member is positioned over the opening but is free to be slid laterally along said guide rails, and also mutually coact to permit said lid member to be moved between the intermediate position and an open position wherein said lid member is positioned away from the opening along either side of the container.

14. The lid assembly for a container of claim 13 wherein there are two of said at least one guide channels, the lid assembly being configured so that the guide channels are to be mounted to the container top on opposite sides of the opening and to the outside of said guide rails.

15. The lid assembly for a container of claim 14 wherein said guide channels each have opposing ends with end plates, and wherein said follower rollers and guide channels are sized and configured so that when said lid member is moved laterally roughly half its width from the closed position along said guide rails, said follower rollers engage with said end plates, stop such lateral movement and permit said lid to be pivoted about said follower rollers until said lid is in the open position.

16. The lid assembly for a container of claim 13 wherein said plurality of rollers are pivotally mounted to said lid member to permit said lid member to move between the closed position and the intermediate position while said plurality of rollers stay in contact with said guide rails.

17. The lid assembly for a container of claim 16 further including springs operably mounted between said lid member and each of said plurality of rollers to bias said each of said plurality of rollers away from said lid member and bias said lid member from the closed position toward the intermediate position.

18. The lid assembly for a container of claim 17 wherein there are at least four of said plurality of rollers and one of said at least one follower rollers mounted to each of the opposing ends of said lid member.

* * * * *